US010709641B2

(12) United States Patent
Yang et al.

(10) Patent No.: US 10,709,641 B2
(45) Date of Patent: Jul. 14, 2020

(54) RHYTHMIC PILL CRUSHER

(71) Applicant: Song Yang, Minhang District Shanghai (CN)

(72) Inventors: Song Yang, Minhang District Shanghai (CN); Hongliang Tian, Jiangsu (CN)

(73) Assignee: SONG YANG, Minhang District Shanghai (CN)

( * ) Notice: Subject to any disclaimer, the term of this patent is extended or adjusted under 35 U.S.C. 154(b) by 218 days.

(21) Appl. No.: 15/770,161

(22) PCT Filed: Nov. 6, 2017

(86) PCT No.: PCT/CN2017/109476
§ 371 (c)(1),
(2) Date: Apr. 20, 2018

(87) PCT Pub. No.: WO2019/061680
PCT Pub. Date: Apr. 4, 2019

(65) Prior Publication Data

US 2019/0091104 A1 Mar. 28, 2019

(30) Foreign Application Priority Data

Sep. 27, 2017 (CN) ..... 2017 1 0890786

(51) Int. Cl.
*A61J 7/00* (2006.01)
*B02C 23/16* (2006.01)
*B02C 19/08* (2006.01)

(52) U.S. Cl.
CPC ..... *A61J 7/0007* (2013.01); *B02C 19/08* (2013.01); *B02C 23/16* (2013.01); *B02C 2023/165* (2013.01)

(58) Field of Classification Search
CPC ..... A61J 7/0007; B02C 19/08; B02C 23/16; B02C 23/165

(Continued)

(56) References Cited

U.S. PATENT DOCUMENTS 4,366,930 A * 1/1983 Trombetti, Jr. ..... A61J 7/0007 241/169
4,694,996 A * 9/1987 Siegel ..... A61J 3/00 100/268

(Continued)

FOREIGN PATENT DOCUMENTS

CN 2723025 Y 9/2005
CN 203001452 U 6/2013

(Continued)

OTHER PUBLICATIONS

International Search Report and Written Opinion regarding PCT/CN2017/109476 dated Jun. 27, 2018.

*Primary Examiner* — Faye Francis
(74) *Attorney, Agent, or Firm* — Dickinson Wright PLLC

(57) ABSTRACT

A rhythmic pill crusher, including: a crushing cover including a cylindrical boss, wherein a plurality of first threads formed on a first wall of the crushing cover and around a column portion of the cylindrical boss, wherein the first wall is distant from the column portion of the cylindrical boss; and a supporting platform including a cylindrical recess for receiving the cylindrical boss and a plurality of second threads formed, in response to the first threads, on a second wall of the supporting platform; wherein the first threads are loosing engaged with the second threads, the first threads spirally go upward and downward along the second threads, or the first threads suspend relative to the second threads, which allows the first threads to rotates remaining in a same height. The pill crusher can be operated efficiently and easily and can be cleaned easily for reducing cross contaminations.

11 Claims, 18 Drawing Sheets

(58) Field of Classification Search
USPC ..... 241/DIG. 27
See application file for complete search history.

(56) References Cited

U.S. PATENT DOCUMENTS

| | | | | | |
|---|---|---|---|---|---|
| 4,714,205 | A * | 12/1987 | Steinko | A47J 19/06 | 241/95 |
| 4,765,549 | A * | 8/1988 | Sherman | A61J 7/0007 | 241/169 |
| 4,967,971 | A * | 11/1990 | Smith | A61J 7/0007 | 241/169 |
| 5,118,021 | A * | 6/1992 | Fiocchi | A61J 7/0007 | 225/103 |
| 5,322,227 | A * | 6/1994 | Fiocchi | A61J 7/0007 | 241/100 |
| 5,553,793 | A | 9/1996 | Klearman et al. | | |
| 6,357,679 | B1 * | 3/2002 | Radke | A61J 7/0007 | 241/169.1 |
| 6,508,424 | B1 * | 1/2003 | Marshall | A61J 7/0007 | 241/169.1 |
| 7,427,041 | B2 * | 9/2008 | Hall | B02C 19/08 | 241/168 |
| 7,543,770 | B2 * | 6/2009 | Peron | A61J 7/0007 | 241/169 |
| 7,735,763 | B2 * | 6/2010 | Bell | B02C 19/08 | 241/169.1 |
| 8,720,807 | B2 * | 5/2014 | Priebe | B02C 19/08 | 241/169 |
| 8,740,119 | B2 * | 6/2014 | Anderson | B02C 19/08 | 241/169.2 |
| 9,827,166 | B2 * | 11/2017 | Evans | A61J 7/0007 | |
| 10,322,416 | B2 * | 6/2019 | Fader | B02C 25/00 | |
| 2016/0310366 | A1 * | 10/2016 | Evans | A61J 7/0023 | |
| 2018/0104152 | A1 * | 4/2018 | Evans | A61J 7/0007 | |

FOREIGN PATENT DOCUMENTS

| | | | |
|---|---|---|---|
| CN | 205587106 | U | 9/2016 |
| DE | 19706341 | A1 | 5/1998 |

* cited by examiner

RHYTHMIC PILL CRUSHER

CROSS REFERENCE TO RELATED APPLICATION

This application is a 371 national phase entry of PCT/CN2017/109476 filed Nov. 6, 2017, which claims the benefit of Chinese Patent Application No. 201710890786.2, filed on Sep. 27, 2017.

TECHNICAL FIELD

The present disclosure relates to the field of medical auxiliary device, and more particularly, to a rhythmic pill crusher.

BACKGROUND

Most oral medicines are taken by patients in the form of pills. The pills, formed in disc or anomalous shape by special process after evenly mixing of medicines and adjuvant materials, can be easily measured in dosage and transported.

Pills can be easily taken by most people, while hardly for patients, the aged or children, who have difficulty in swallowing. Therefore, for those people, the pills are needed to be crushed into powders, to be swallowed along with liquid, under the function of pill crushers.

An existing pill crusher usually crushes pills by smashing with large manual forces in short time, causing one problem of difficulty in implement for the manual forces, and another problem of unnecessary noise. Another kind of pill crushers usually crushes pills with a lever structure. When this kind of pill crushers are used, the pills are put between two splints and crushed by a handpiece, causing one problem of difficulty in applying forces evenly, the handpiece is easily stuck for instantaneous excessive manual forces, and another problem of unnecessary noise.

Compared to the above two kinds of pill crushers, rotating pill crushers are more suitable for quiet medical environment. The rotating pill crushers usually crush pills with the pressing forces along with the rotary. If the pill crushers are stuck for large hardness of the pills, the pill crushers are needed to be rotated reversely, which is a waste of time and energy. The pill crushers are also needed to be cleaned for crushing different kinds of pills, and cannot be operated continuously, cross contamination may also occur if the pill crushers are not well cleaned.

A pill crusher operated efficiently and easily, and cleaned easily for reducing opportunities of cross contaminations is needed.

SUMMARY

The primary purpose of the present disclosure is to provide a rhythmic pill crusher. The pill crusher can be operated efficiently and easily and can be cleaned easily for reducing cross contaminations.

According to one aspect of the present disclosure, a rhythmic pill crusher includes a crushing cover and a supporting platform, wherein, the crushing cover includes a cylindrical boss, a plurality of first threads are formed on a first wall of the crushing cover and around a column portion of the cylindrical boss, and the cylindrical boss includes a first crushing portion formed on a bottom face, the first wall is distant from the column portion of the cylindrical boss; and the supporting platform includes a cylindrical recess for receiving the cylindrical boss and a plurality of second threads are formed, in response to the first threads, on a second wall of the supporting platform, and a second crushing portion is formed, according to the first crushing portion, on bottom of the cylindrical recess; wherein the first threads are loosing (i.e., loosely) fit with the second threads, and groove width of the threads is larger than ridge with of the threads, the first threads spirally go upward and downward along the second threads, or the first threads suspend relative to the second threads, which allows the first threads to rotates remaining in a same height.

BRIEF DESCRIPTION OF THE DRAWINGS

Embodiments of the present disclosure will now be described, by way of example only, with reference to the accompanying schematic drawings in which corresponding reference symbols indicate corresponding parts, and in which.

DETAILED DESCRIPTION

Figure 1:
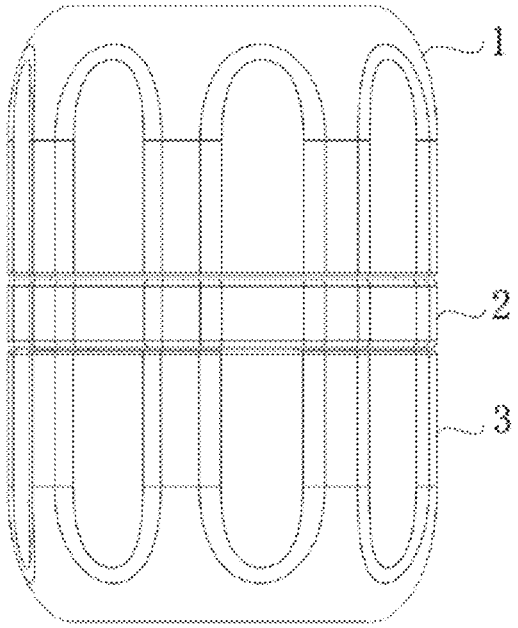
FIG. 1 shows a schematic view of a rhythmic pill crusher of one embodiment of the present disclosure.
Figure 2:
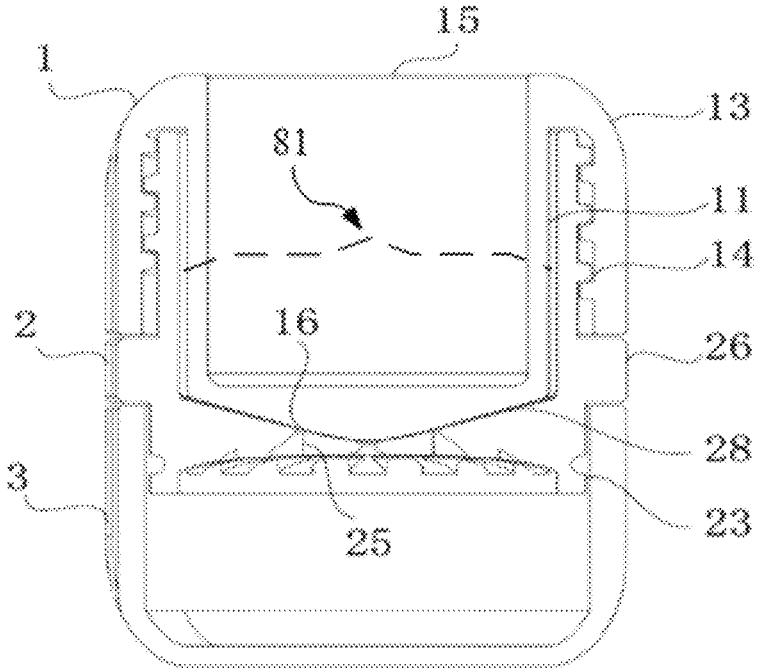
FIG. 2 shows a cross-sectional view of a rhythmic pill crusher of one embodiment of the present disclosure.
Figure 3:
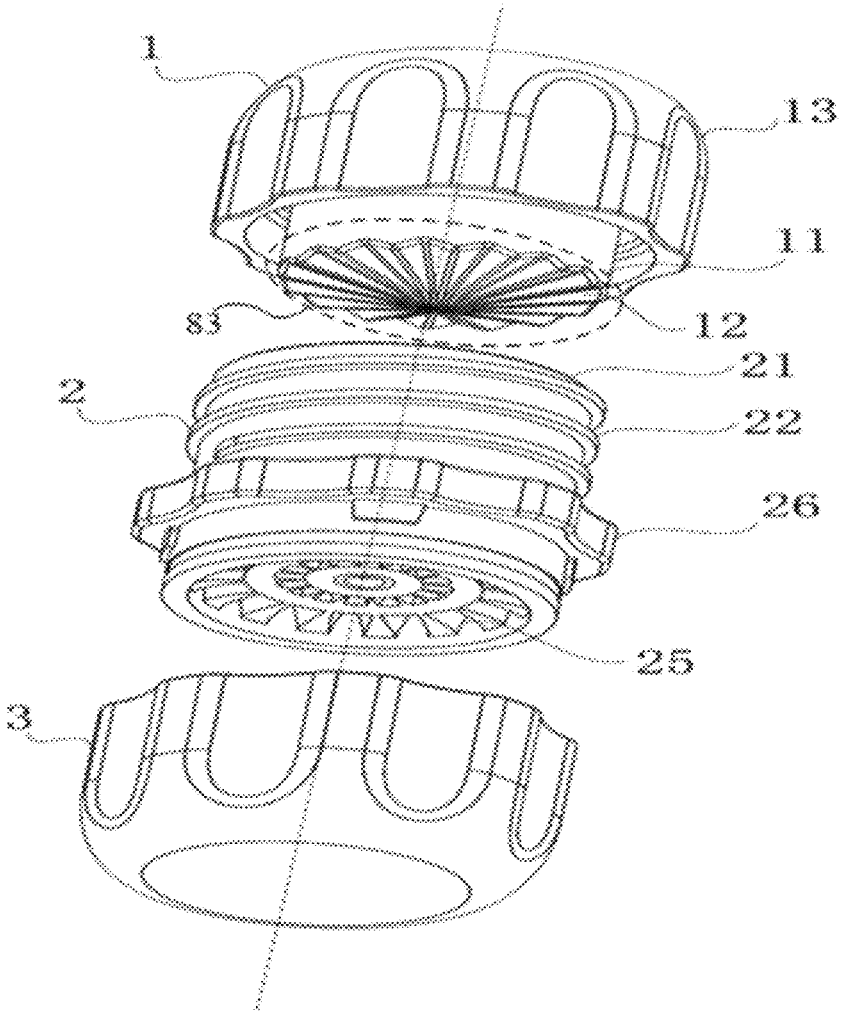
FIG. 3 shows an explosive view of a rhythmic pill crusher of one embodiment of the present disclosure.
Figure 4:
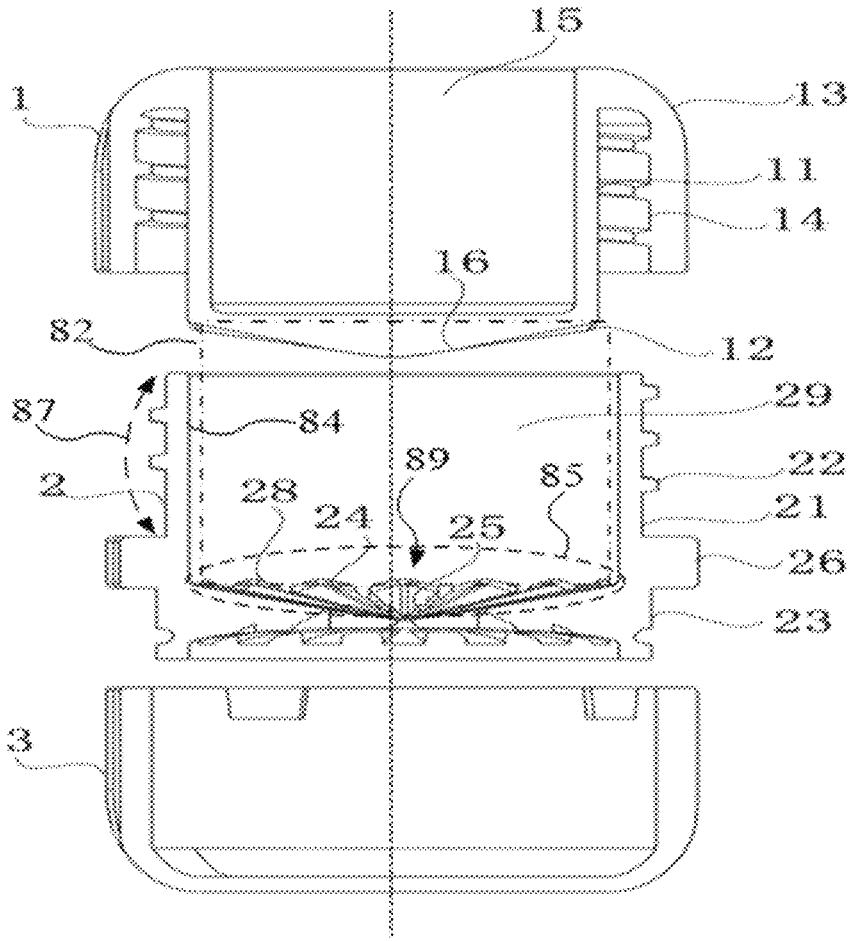
FIG. 4 shows a cross-sectional view of a rhythmic pill crusher in explosive state of one embodiment of the present disclosure.
Figure 5:
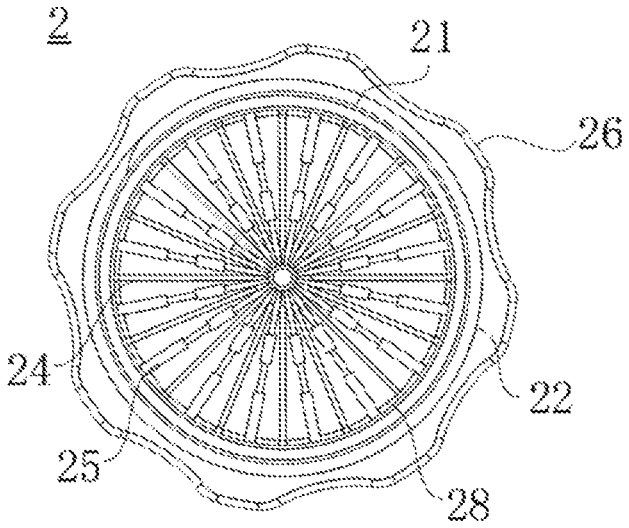
FIG. 5 shows a top view of a support platform of one embodiment of the present disclosure.
Figure 6:
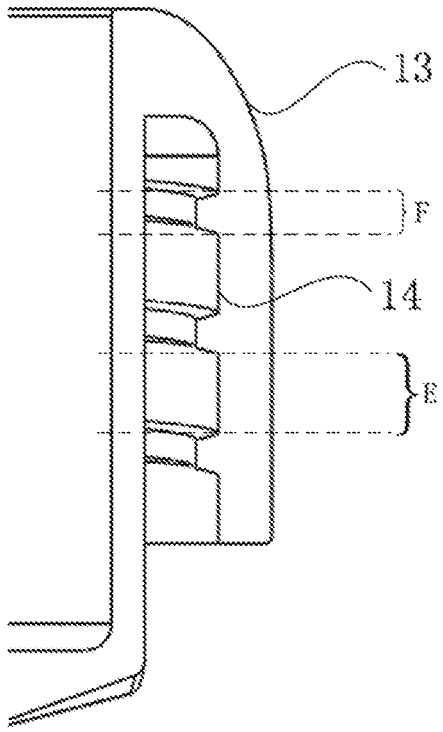
FIG. 6 shows a cross-sectional view of a part of a crushing cover of one embodiment of the present disclosure.
Figure 7:
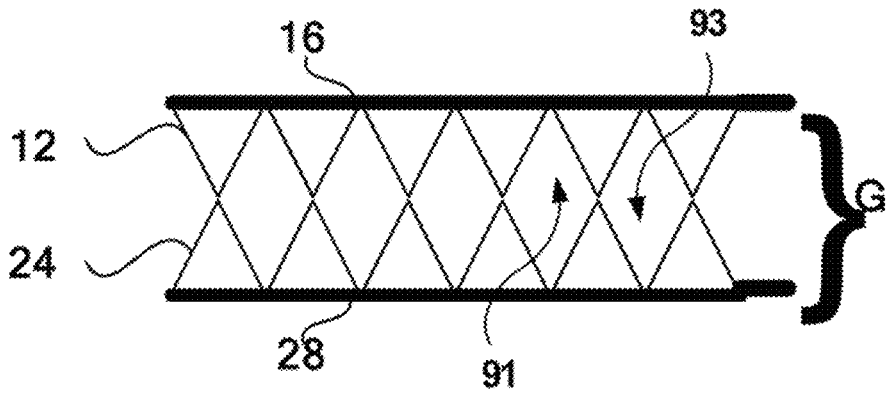
FIG. 7 shows a schematic view of first ridges abutting against second ridges.
Figure 8:
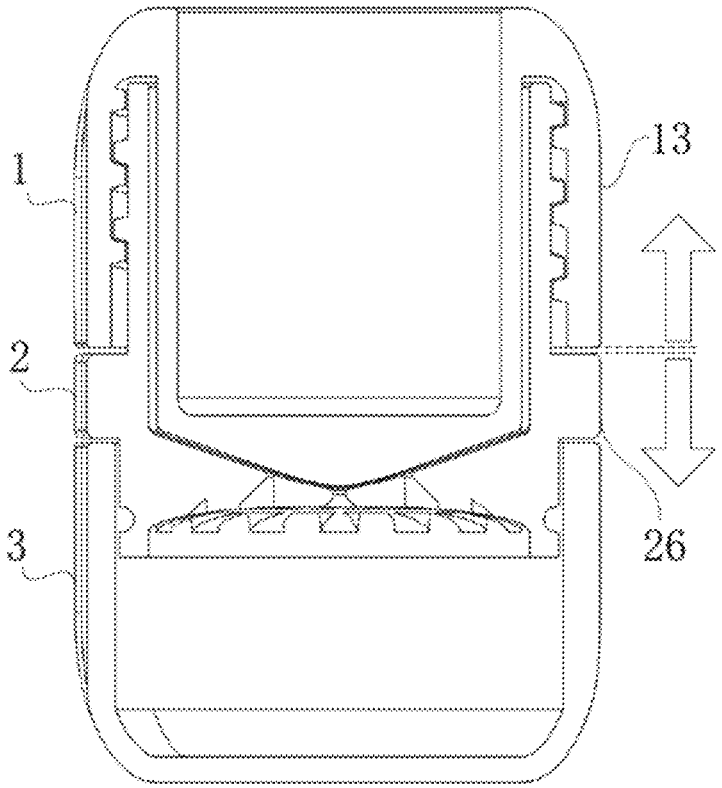
FIG. 8 shows a cross-sectional view of a rhythmic pill crusher when first ridges abut against second ridges.

In the following, embodiments of the present disclosure will be described in detail referring to figures. The concept and its realizations of the present disclosure can be implemented in a plurality of forms, and should not be understood to be limited to the embodiments described hereafter. In contrary, these embodiments are provided to make the present disclosure more comprehensive and understandable, and so the conception of the embodiments can be conveyed to the technicians in the art fully. Same reference signs in the figures refer to same or similar structures, so repeated description of them will be omitted.

The features, structures or characteristics described can be combined in any appropriate way in one or more embodiments. In the description below, many specific details are provided to explain the embodiments of the present disclosure fully. However, the technicians in the art should realize that, without one or more of the specific details, or adopting other methods, components, materials etc., the technical proposal of the present disclosure can still be realized. In certain conditions, structures, materials or operations well known are not shown or described in detail so as not to obfuscate the present disclosure.

The technical contents of the present disclosure will be further described below with reference to the figures and embodiments.

It should be stated that a plurality of embodiments described below along with their combinations and varieties, beyond doubt are within the scope of the present disclosure.

As shown in FIGS. 1 to 6, in one embodiment of the present disclosure the rhythmic pill crusher includes a crushing cover 1, a support platform 2 and a cup 3. The crushing cover 1 includes a cylindrical boss 11, a plurality of first threads 14 formed on a first wall, an annular side wall 13 of the crushing cover 1, and around a column portion 81 of the cylindrical boss 11. In this embodiment, the first wall includes an inner wall of the crushing cover. The annular side wall 13 is distant from the column portion of the cylindrical boss. The cylindrical boss includes a first crushing portion 16 formed on a bottom face 83. The support platform 2 includes a cylindrical recess 85 for receiving the cylindrical boss 11 and a plurality of second threads 22 formed, corresponding to the first threads 14, on a second wall which is an external wall of the supporting platform 2. The cylindrical recess is formed in an annular wall 21, and the second threads 22 are formed on the external side of the annular wall 21. A platform 23 is formed in the annular wall 21 and a second crushing portion 28 is formed, corresponding to the first crushing portion, on a bottom face 89 of the cylindrical recess 85. The second crushing portion 28 of the platform 23 and the inner side of the annular wall 21 form a crushing space 29. A plurality of patterned holes 25 are formed on the second crushing portion, for sifting powder out of a crushing chamber 82. Groove width E of the threads is larger than ridge width F of the threads. In the present disclosure, the ridge width F means distance between two adjacent roots corresponding to a same crest, the groove width E means the distance between two adjacent roots corresponding to two adjacent crests respectively, the sum of the ridge width F and the groove width E is equal to thread pitch (distance between two adjacent crests). The first threads 14 are loosely fit with the second threads 22 which allow the first threads 14 spirally go upward and downward, and rotate along the second threads 22 to drive the first crushing portion 16 to engage with the second crushing portion 28 rhythmically. The cup 3 under the support platform 2 is configured to store the powders falling through the patterned holes 25. The first crushing portion 16 includes a conical protrusion received by a conical recess of the second crushing portion 28. The number of the patterned holes 25 is gradually increased from edge to the center of the second crushing portion 28.

The pills can be crushed by lightly applying driving forces on the crushing cover 1 to form interactions of the first threads 14 and the second threads 22, and be grinded with interactions of the first crushing portion 16 and the second crushing portion 28.

There is a free distance much larger than a fit clearance of normal threads (normally about 0.3 mm), preferably the free distance is about 2 mm-3 mm, or 2 cm-3 cm. The distance allows the crushing cover spirally to go upward and downward and rotate along the support platform without displacement in height, so the rotation cannot be forced to move in height by the threads. The loosing fit threads can realize the function of normal threads, that is, driving the crushing cover to move towards the support platform when rotated positively, to crush the pills, and separating the crushing cover and the support platform when the rotated reversely. When the pills are hard to be crushed, the crushing cover can be rotated reversely in a small degree to make the crushing cover into the free distance, the crushing cover can be operated manually to grind the pills back and forth with the rhythmic engagement between the first and second crushing portions. For normal threads, the crushing portions will get close to and way from each other along with the rotation, and cannot realize normal grinding.

Ridge width of the first threads 14 and the second threads 22 is in a range of 0.1 mm to 10 mm, groove width of the first threads 14 and the second threads 22 is in a range of 0.2 mm to 20 mm.

In the embodiment, a plurality of first ridges 12 are axis-symmetrically formed, around the central axis of the cylindrical boss 11, on the first crushing portion 16, and a plurality of second ridges 24 are axis-symmetrically formed, around the central axis of the support platform 2, on the second crushing portion 28. The first ridges 12 include a plurality of first protrusions formed, around the center axis of the cylindrical boss 11, and radially extended along a plurality of straight lines, the second ridges 24 include a plurality of second protrusions formed, around the center axis of the cylindrical recess, and radially extended along a plurality of straight lines. The size of the first protrusion is equal to the size of the second protrusion and the gap 91 of the two adjacent first protrusions is equal to the gap 93 of adjacent second protrusions. In another embodiment, the first ridges 12 include a plurality of third protrusions formed, around the center axis of the cylindrical boss 11, and radially extended along a plurality of curves, the second ridges 24 include a plurality of fourth protrusions formed, around the center axis of the cylindrical recess, and radially extended along a plurality of curves. The size of the third protrusion is equal to the size of the fourth protrusion and the gap of the two adjacent third protrusions is equal to the gap of adjacent fourth protrusions. The first ridges 12 and the second ridges 24 can also be protrusions and recesses, respectively; or protrusions and locating slots, respectively. The first ridge 12 is extruded in a range of 0.1 mm to 10 mm in height from the first crushing portion 16, and the second ridge 24 is extruded in a range of 0.1 mm to 10 mm in height from the second crushing portion 28.

In the embodiment, a recess 15 for storing pills is formed in the cylindrical boss 11, a cover (not shown in the figures) can be used to cover the recess 15. The pills can be stored in the recess 15 and can be taken out when the cover is open.

As shown in FIGS. 7 to 10, the first threads 14 of the crushing cover 1 are engaged with the second threads 28 of the support platform 2. A crushing space 29 is formed between the first crushing portion 16 and the second crushing portion 28. The cylindrical boss 11 of the crushing cover 1 enters into the crushing space 29 rotationally, when the pills are crushed by first threads 12 and the second threads 24, a distance between the first ridges 12 and the second ridges 14 is changed according to interactions of the first ridges 12 and the second ridges 14. The crushing cover 1 goes up and down along the center axial of the support platform 2.

When the first threads 12 abut against the second threads 24, the tip of each first ridge 12 contacts with the tip of each second ridge 24, and each first ridge 12 won't fall into a gap between adjacent second ridges 24, and vice versa. The gap G between the first crushing portion 16 and the second crushing portion 28 is the sum of the heights of the first ridge 12 and the second ridge 24 (a shown in FIG. 7).

Figure 9:
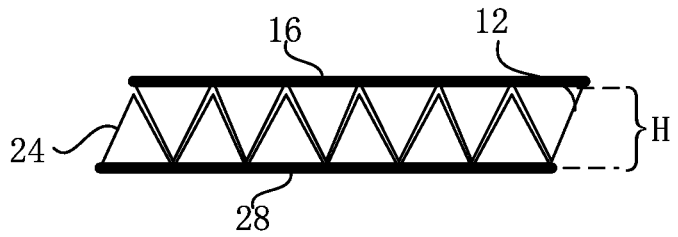
FIG. 9 shows a schematic view of a first ridges engaging with second ridges.
Figure 10:
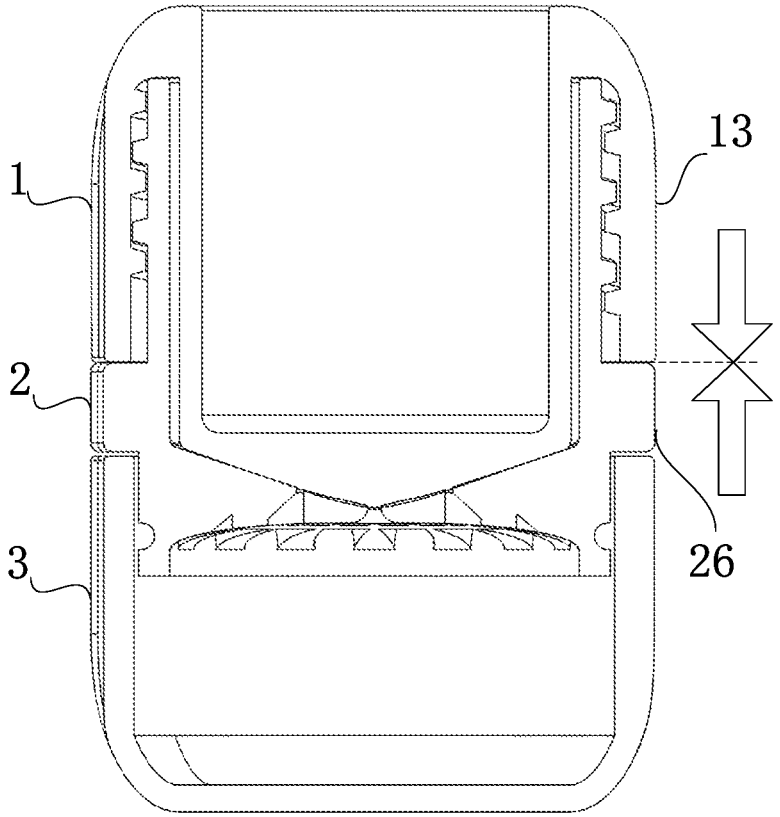
FIG. 10 shows a cross-sectional view of a rhythmic pill crusher when first ridges engage with second ridges.

When the first ridges 12 engage with the second ridges 24, each first ridge 12 at least partially falls into a gap between two adjacent second ridges 24, and vice versa. The gap H between the first crushing portion 16 and the second crushing portion 28 is smaller than the height of the first ridge 12 or the second ridge 24 (as shown in FIG. 9). The rhythmic amplitude K is the value of the biggest gap G subtracting the smallest gap H, that is, K=G-H.

In the embodiment, groove width E is greater than or equal to the sum of ridge width F and the rhythmic amplitude K, that is, $E \geqslant F+K$. The height of the groove E subtracting ridge width F is the height range to receive the grinding ridges. With the adjustment of the value of E−F, the movement range in height of the crushing cover without the restriction of threads can be adjusted. The range also decides the reverse rotating degree to allow the threads rotate without displacement in height. The rhythmic grinding of the first ridges 12 and the second ridges 24 can change the stacking form of the powders faster, to prevent the pills from stuck. On the contrary, groove width b of regular thread=ridge width a+tolerance, there is no allowable height range for the grinding ridges (the diameter of screw and nut is also related to, for example, screws of M1, M2, M3 all have size ranges general in world). Therefore, regular threads cannot realize the rhythmic effect of the present disclosure.

The existing rotating pill crusher all use regular threads. Groove width of existing pill crusher is almost the same with ridge width. When the pills are stuck, the crushing cover cannot be rotated downwards, the powders cannot be pressed down, the crushing cover has to be rotated reversely to separate the crushing cover and the powders. Therefore, the existing rotating pill crusher cannot realize the effect of the present disclosure, that is, when the pills are stuck, the crushing portions can grind the powders rhythmically, the effect of rhythmic grinding can also rearrange the powders and expel the powders from the bottom of the crushing space in time.

The first crushing portion 16 includes the conical protrusion received by the conical recess of the second crushing portion. The number of the patterned holes 25 is gradually increased from the center to the edge of the second crushing portion, so the powders on the center of the conical recess of the second crushing portion 28 can fall through the patterned holes 25 to the cup 3. During the rhythmic rotation, the powders are expelled to fall through the patterned holes 25 continuously, that is, the powders in the crushing space 29 decreases continuously, and the stacking form of the powders on the second crushing portion 28 are changed continuously, to prevent the pill crusher from stuck.

In the embodiment, the supporting platform includes a shoulder formed around the external of the crushing platform 2 and against a bottom face of the annular side wall 13. As the first ridges 12 abuts against and engages with the second ridges 24 alternately to form rhythmic interactions, the annular side wall 13 abuts against and engages with the shoulder 26 alternatively. When the annular side wall 13 abuts against the shoulder 26, no air is allowed into the crushing space 29, while when the annular side wall 13 engages with the shoulder 26, air is allowed into the crushing space 29, therefore, air is guided into the crushing space 29 intermittently, to blow off the powders on the first crushing portion 16 and the second crushing portion 28 to get the crushing portions cleaned, and the powders will fall through the patterned holes 25 into the cup 3 faster.

In the embodiment, the crushing cover 1, the support platform 2 and the cup 3 are entirely or partially made by transparent material, to make the grinding status of the pills visible.

The pill crusher of the present disclosure can not only be used to crush pills, but also can be used to crush other stuff or food, such as fruits, seasoner, candies and so on, the pill crusher can also be operated effectively by lightly applying driving forces, and can be cleaned easily for reducing cross contaminations.

The function of the first crushing portion 16 and the second crushing portion 28 during the use of the pill crusher is described below.

Figure 11:
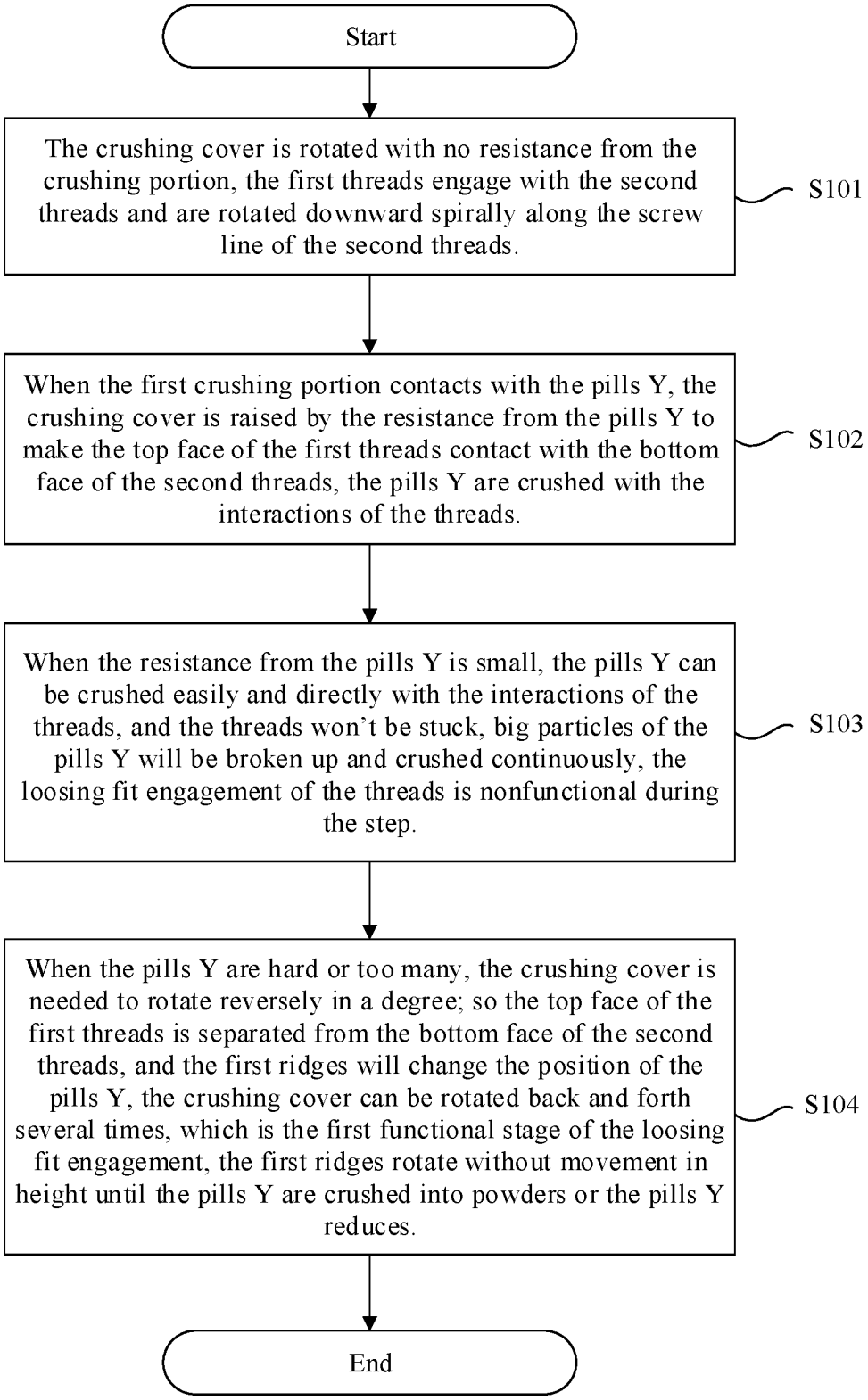
FIG. 11 shows a flow chart of crushing period and early grinding period.

S100: crushing period and early grinding period, as shown in FIG. 11, includes the following steps:

S101: the crushing cover is rotated with no resistance from the crushing portion, the first threads of the crushing cover engage with the second threads of the support platform and are rotated downward spirally along the screw line of the second threads.

S102: when the first crushing portion contacts with the pills Y, the crushing cover is raised by the resistance from the pills Y to make the top face of the first threads contact with the bottom face of the second threads, the pills Y are crushed with the interactions of the threads.

S103: when the resistance from the pills Y is small, the pills Y can be crushed easily and directly with the interactions of the threads, and the threads won't be stuck, big particles of the pills Y will be broken up and crushed continuously, the loosing fit engagement of the threads is nonfunctional during the step.

S104: when the pills Y are hard or too many, the resistance from the pills Y is large, when the first crushing portion goes downwards, the pills Y will be stuck in the gap between adjacent protrusions of the first and second crushing portions. The crushing cover is needed to rotate reversely in a degree (0°-360°). On the one hand, the top face of the first threads is separated from the bottom face of the second threads, to form the movement range in height of the threads, on the other hand, during the reverse rotation, the first ridges will change the position of the pills Y, which is favorable for the next crushing. The crushing cover can be rotated back and forth several times, with the loosing fit engagement of the threads, and under a certain manual pressure, the first ridges rotate without movement in height until the pills Y are crushed into powders or the pills Y reduces, which is the first functional stage of the loosing fit engagement, then continue step S103.

During the step 101 to step 104, as long as groove width is bigger than ridge width, the grinding remaining in a same height can be realized. As the ridge width remains the same, the bigger the width of the groove width is, the bigger the rotating angle remaining in a same height can be realized.

Figure 12:
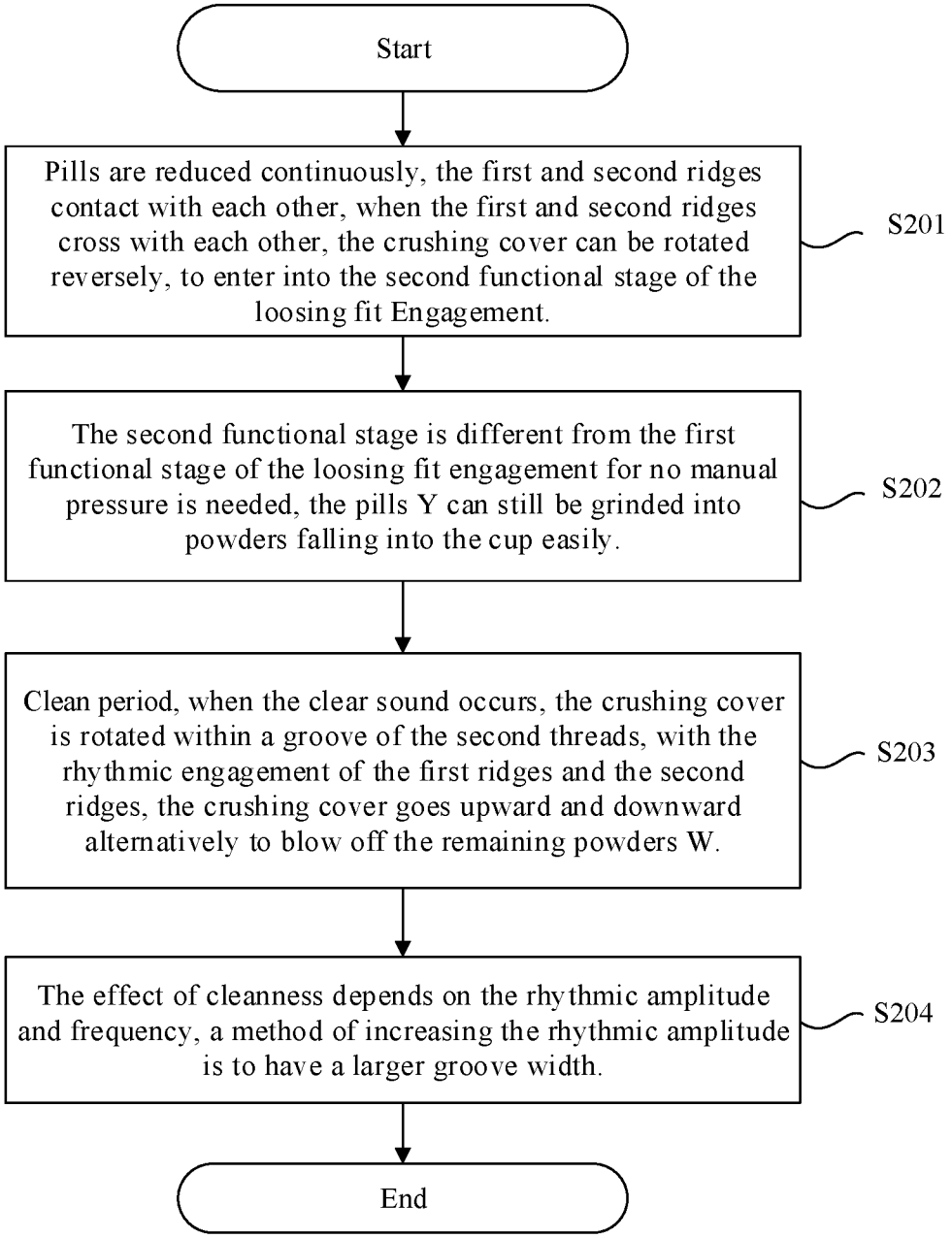
FIG. 12 shows a flow chart of late grinding period and clean period.
Figure 13:
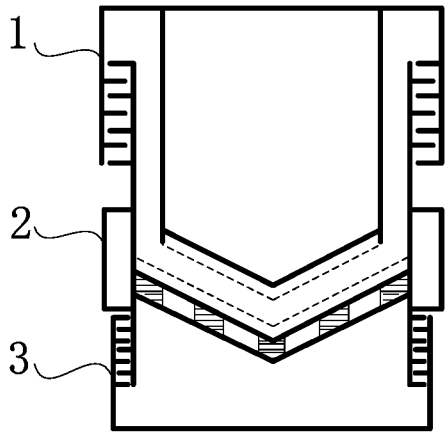
FIG. 13 to FIG. 22 show schematic views of a using process of a rhythmic pill crusher.
Figure 14:
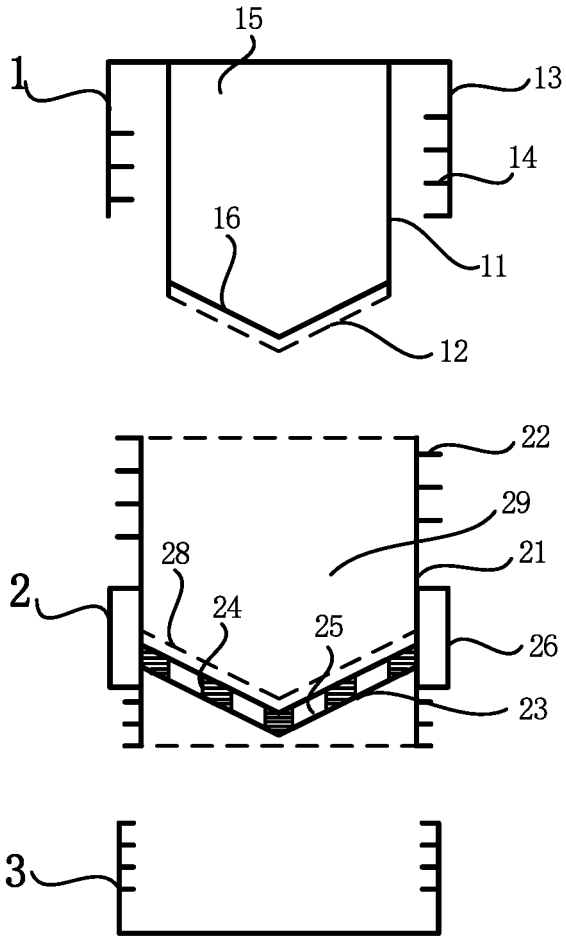
Figure 15:
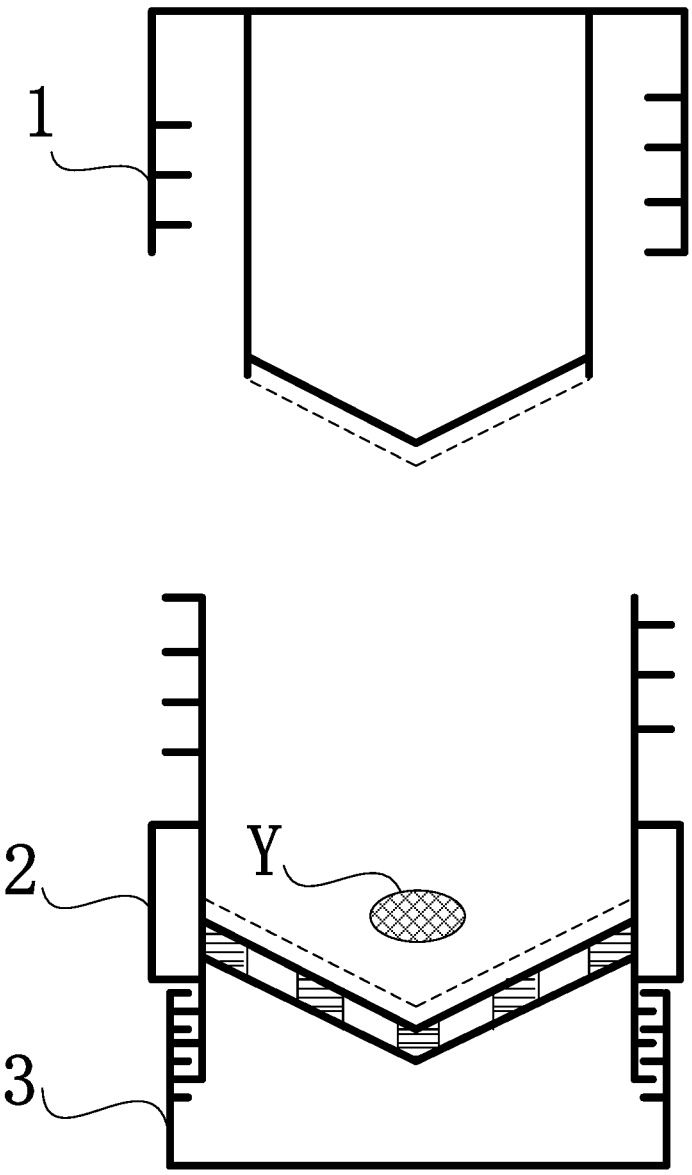
Figure 16:
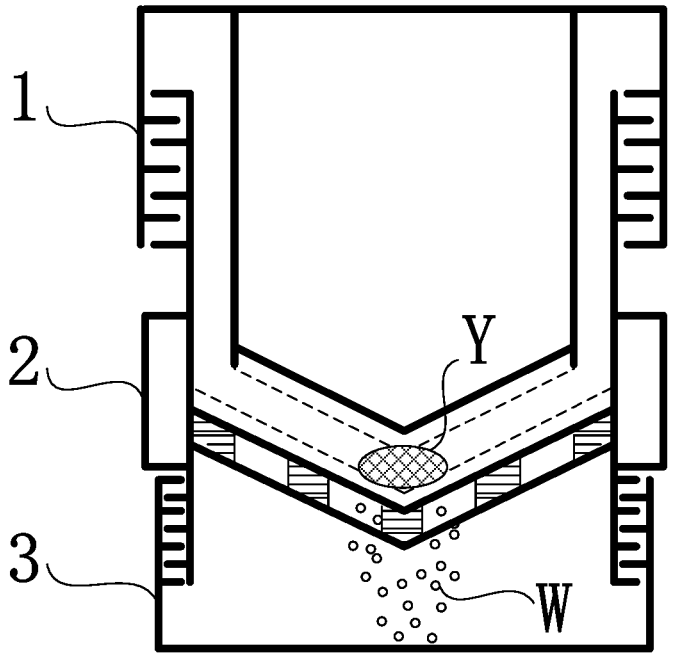

S200: late grinding period (only small quantity of particles between the crushing portions) to clean period, as shown in FIG. 12, includes the following steps:

S201: pills are reduced continuously, the first and second ridges contact with each other, if the crushing cover continued to be rotated, (the top face of the first threads contacts with the bottom face of the support platform) the first and second ridges will be stuck, even be locked (clean period). Therefore, during late grinding period, the crushing cover is not needed to be rotated continuously, when the first and second ridges cross with each other (a clear sound occurs), the crushing cover can be rotated reversely, to enter into the second functional stage of the loosing fit engagement.

S202: the second functional stage is different from the first functional stage of the loosing fit engagement in S104 for no manual pressure is needed, the pills Y can still be grinded into powders falling into the cup easily.

S203: the clean stage can refer to the above step S201, when the clear sound occurs, the crushing cover is rotated within a groove of the second threads, with the rhythmic engagement of the first ridges and the second ridges, the crushing cover goes upward and downward alternatively to blow off the remaining powders W.

S204: the effect of cleanness depends on the rhythmic amplitude and frequency, a method of increasing the rhythmic amplitude is to have a larger groove width. The larger the rhythmic amplitude is, the better the pills Y can be grinded during the second functional stage of the loosing fit engagement.

During the step 201 to the step 204, the rhythmic frequency is positively related to the number of the ridges, but the number of the ridges is less restricted by the loosing fit engagement.

FIGS. 13 to 22 show schematic views of the using process of the rhythmic pill crusher. As shown in FIGS. 13 to 20, the present disclosure further provides a method of using the rhythmic pill crusher, to crush pills, including a rotating crushing stage and a grinding stage.

Figure 17:
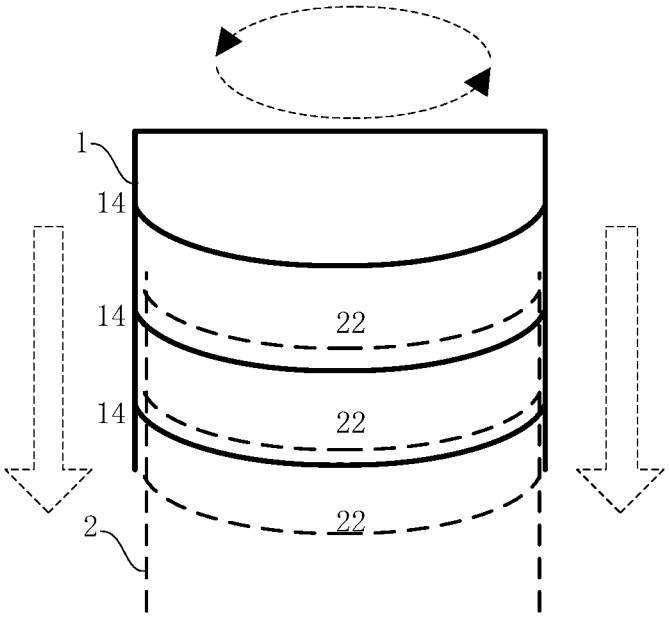

As shown in FIGS. 13 to 17, the rotating crushing stage includes: rotating the crushing cover 1, the crushing cover 1 is driven to rotate towards the support platform 2, the powders of the pills fall through the patterned holes 25. Specifically, the crushing cover 1 and the support platform 2 are separated, the pills Y are put in the support platform 2, then the first threads 14 are engaged with the second threads 22 the crushing cover 1 is rotated downwards along the second threads 22. Meanwhile, the first threads 14 are close to the second threads 22, the crushing cover 1 can rotate downwards along the axis direction (as shown in FIG. 17). The first ridges 12 of the first crushing face 16 contact with the second ridges 24 of the second crushing face 28 to grind the pills Y, the generated powders W fall through the patterned holes 25 into the cup 3. The rotating crushing stage is very useful for crushing the pills at the beginning.

Figure 18:
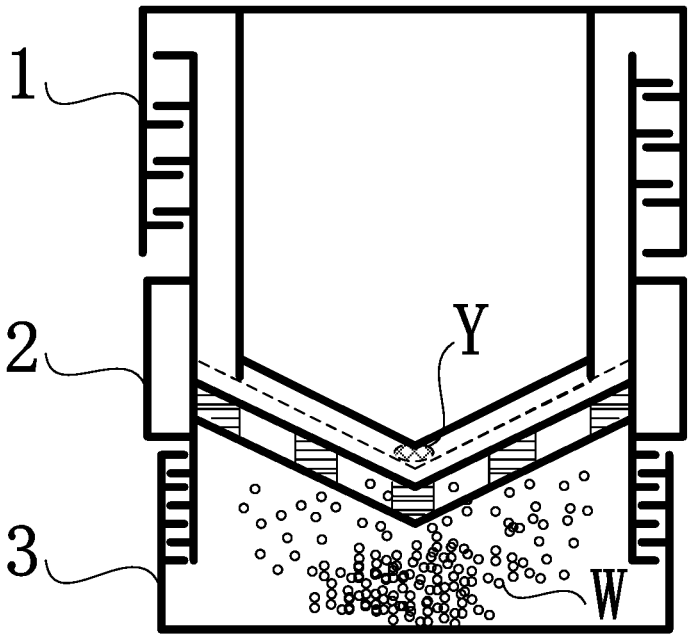
Figure 20:
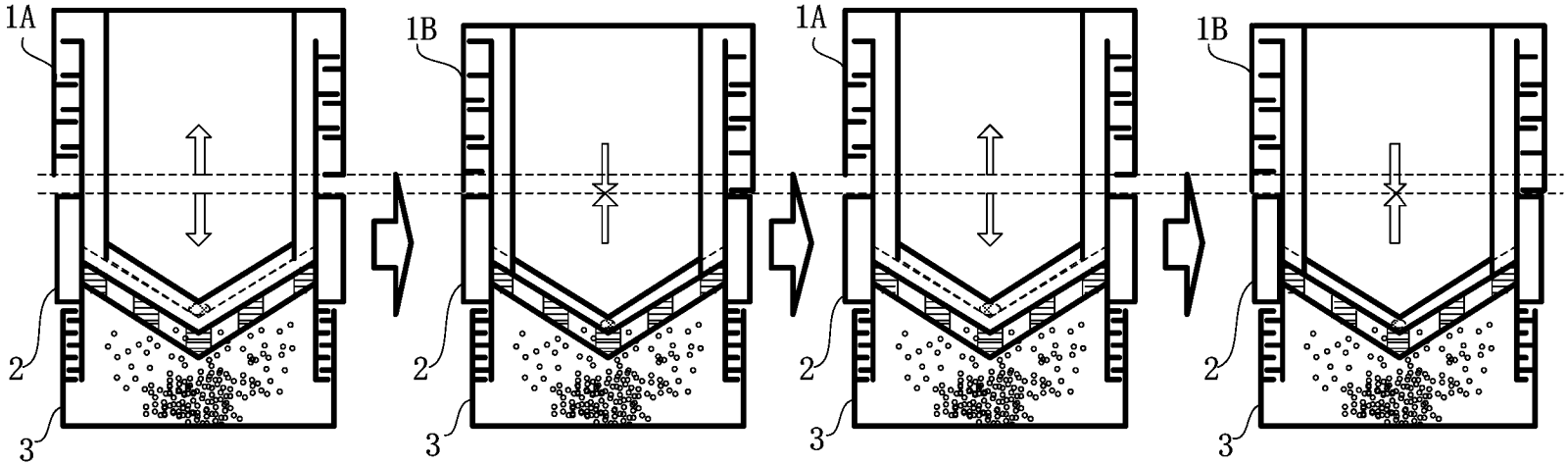

As shown in FIGS. 18 and 20, the grinding stage: when the powders are stacked and cannot be pressed downwards, the crushing cover 1 can be rotated reversely or back and forth, the first threads 14 of the crushing cover 1 cooperates with the second threads 22 of the support platform 2 loosely, and the crushing cover 1 is not restrained by the second threads 22 in a certain height range, the first crushing face 16 of the crushing cover 1 is rotated relative to the second threads 22 of the support platform 2 within a certain gap, to grind the powders.

Figure 19:
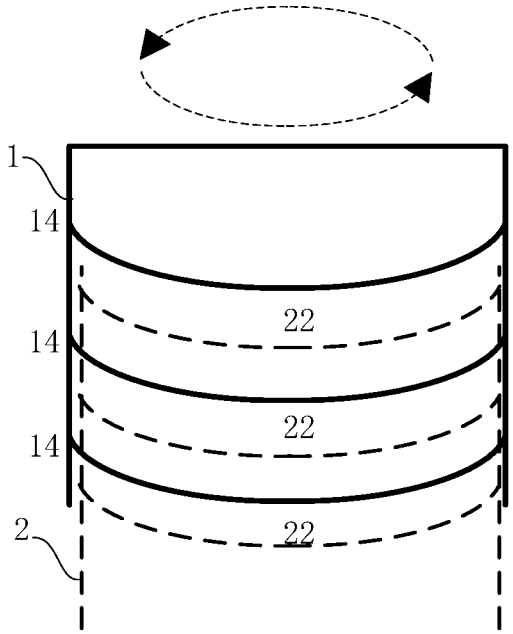

In the present disclosure, according to the state of the pills, the rotating crushing stage and the grinding stage are performed alternatively. During the rotating crushing stage, when the crushing cover 1 cannot go downwards relative to the second crushing portion 28, the grinding stage is performed instead; during the grinding stage, when the powders are grinded by the crushing cover 1 to get a new space for the crushing cover 1 going down, the rotating crushing stage is performed instead. As the groove width is large enough, the thread can be moved upwards and downwards in the height range of the groove. When the first threads 14 are suspended relative to the second threads 22, even the first threads are rotated in a certain angle, the height between the first crushing cover 1 relative to the support platform 2 won't be changed (as shown in FIG. 19). Therefore, the pills can be grinded on the second crushing portion 28 of the support platform 2 by the first crushing portion 16, in the form of rotating the crushing cover back and forth. The pill crusher is prevented from stuck during the grinding stage.

During the rotating crushing stage, the crushing cover 1 can be rotated in 0° to 180° without the restriction of the second threads 22. When the rotating angle of the crushing cover 1 relative to the support platform 2 is smaller than 180°, the first threads 14 are suspended relative to the second threads 22; when the rotating angle of the crushing cover 1 relative to the support platform 2 is larger than 180°, the first threads 14 contacts with the second threads 22 and rotates along the screw line of the second threads 22. Therefore, as long as the rotating angle back and forth is smaller than 180°, the grinding effect can be realized. In a preferable embodiment, during the rotating crushing stage, the crushing cover 1 can be rotated in 0° to 60°, or 0° to 90°, or 0° to 120° without the restriction of the second threads 22. The rotating angle limitation can be set according to specific requirement of grinding, and not limited to the above ranges. During the rotating crushing stage, the first crushing portion is close to the second crushing portion 28, to have a better grinding effect.

With the distance between the first crushing portion 16 and the second crushing portion 28 remains the same, the stacking form of the powders can be changed fast with the grinding of the crushing cover 1 in a same height, when the powders are grinded into finer powders, the first threads 14 can be pushed downwards to contact with the second threads 22 and rotated downwards along the screw line of the second threads 22 (back to rotating crushing stage). The existing rotating pill crushers all use regular threads. The groove width of existing pill crusher is almost the same with the ridge width. When the pills are stuck, the crushing cover cannot be rotated downwards, the powders cannot be pressed down, the crushing cover has to be rotated reversely to separate from the powders. Therefore, the existing rotating pill crusher cannot realize the effect of the present disclosure.

Figure 21:
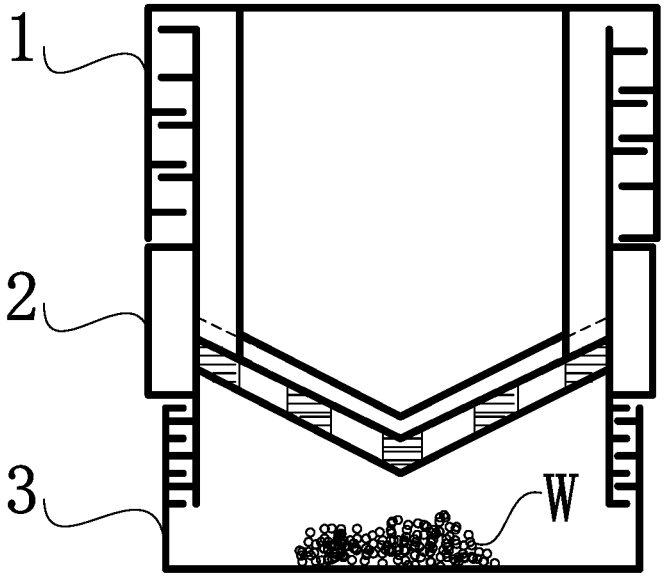
Figure 22:
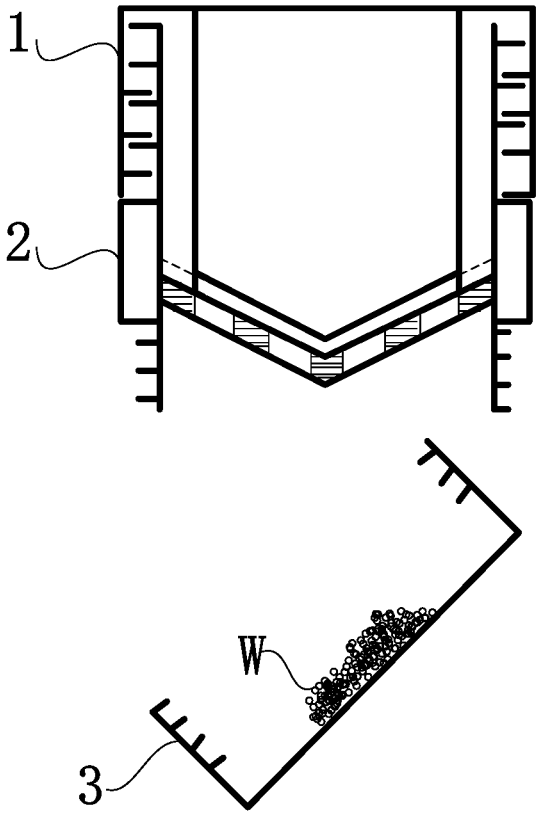

As shown in FIG. 21, no matter during the rotating crushing stage or the grinding stage, the first ridges 12 abuts against and engages with the second ridges 28 rhythmically. The distance between the first crushing portion 16 and the second crushing portion 28 is changed according to interactions of the first ridges 12 and the second ridges 24. The interactions of the first ridges 12 and the second ridges 24 can change the stacking form of the powders fast, to prevent from stuck.

The first ridges and the second ridges can only realize the rhythmic grinding with the loosing fit threads, as the regular threads cannot realize the rotation of the crushing cover 1 remaining in a same height. With the loosing fit threads and the rhythmic interactions of the first and second ridges, the pills can be grinded fastest, so the powders can be grinded into finer powders faster by lightly applying driving forces.

Figure 23:
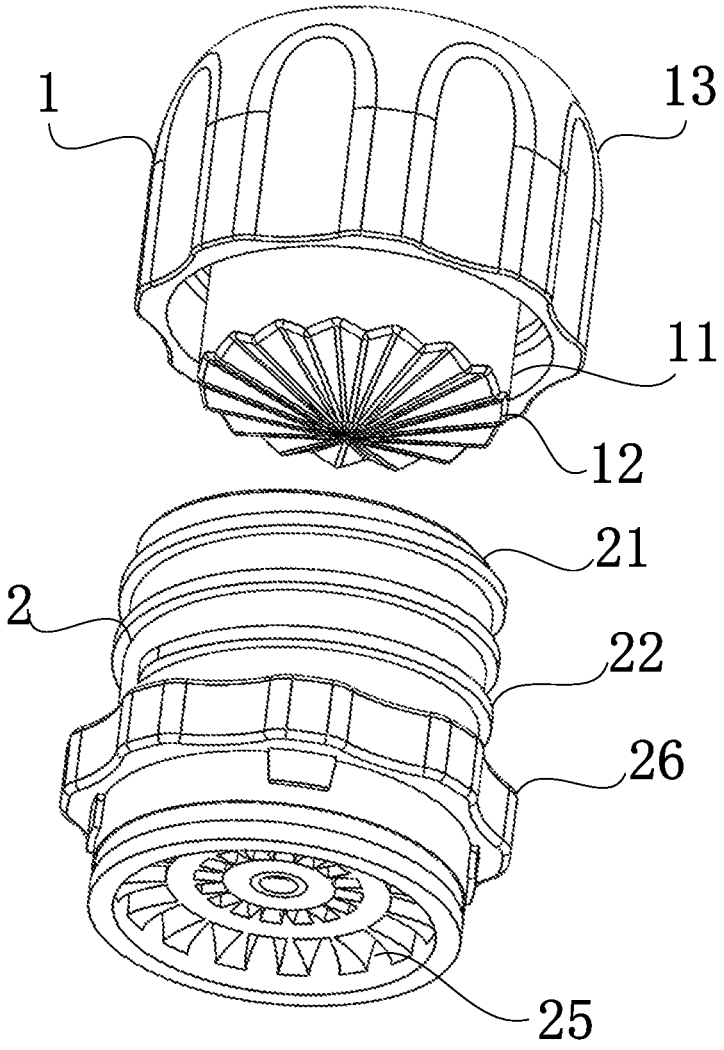
FIG. 23 shows a schematic view of a rhythmic pill crusher of another embodiment of the present disclosure.

As shown in FIGS. 21 and 23, when the pills Y are entirely grinded into powders W, the cup 3 and the support platform 2 can be separated to take out the powders W in the cup 3.

Figure 24:
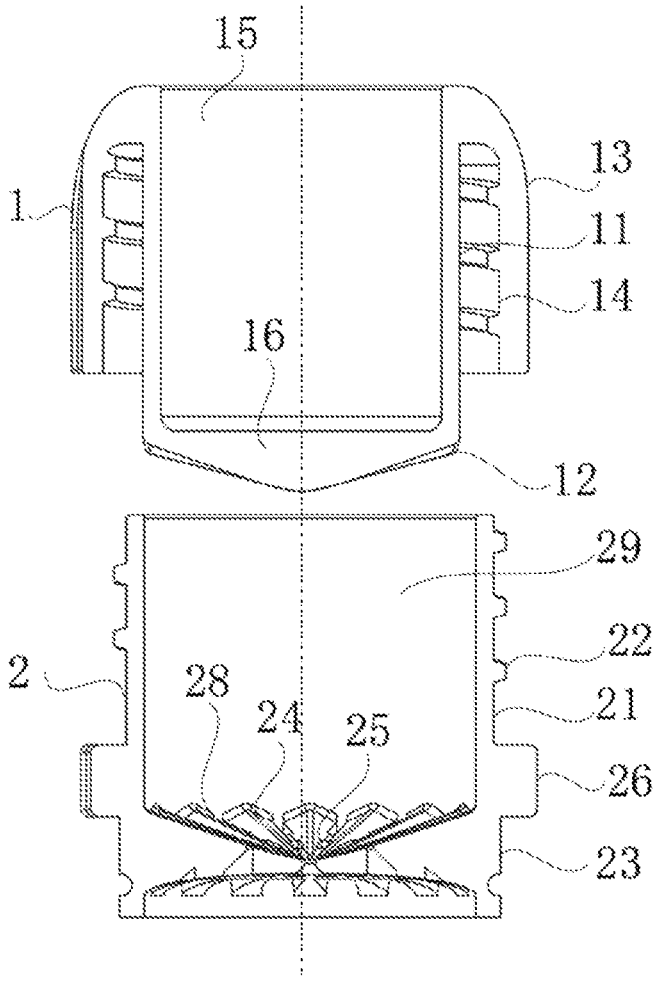
FIG. 24 shows a cross-sectional view of a rhythmic pill crusher of FIG. 23.

As shown in FIG. 21, no matter during the rotating crushing stage or the grinding stage, the first ridges 12 abuts against and engages with the second ridges 28 rhythmically. The distance between the first crushing portion 16 and the second crushing portion 28 is changed according to interactions of the first ridges 12 and the second ridges 24. The interactions of the first ridges 12 and the second ridges 24 can change the stacking form of the powders fast, to prevent from stuck. As shown in FIGS. 23 and 24, in another embodiment the rhythmic pill crusher include a crushing cover 1 and a support platform 2 (no cup 3). The crushing cover 1 includes a cylindrical boss 11, a plurality of first threads 14 formed on a first wall, an annular side wall 13 of the crushing cover 1, and around a column portion of the cylindrical boss 11. In this embodiment, the first wall includes an inner wall of the crushing cover. The cylindrical boss 11 includes a first crushing portion 16 formed on a bottom face. The support platform 2 includes a cylindrical recess for receiving the cylindrical boss 11 and a plurality of second threads 22 formed, to the first threads, on a second wall, which is an external wall of the supporting platform 2. The cylindrical recess is formed in an annular wall 21, and the second threads 28 are formed on the external side of the annular wall 21. A platform 23 is formed in the annular wall 21 and a second crushing portion 28 is formed, according to the first crushing portion 16, on bottom of the cylindrical recess. The second crushing portion 28 of the support platform 2 and the inner side of the annular wall 21 form a crushing space 29. A plurality of patterned holes 25 are formed on the second crushing portion 28, for sifting powder out of the crushing chamber. Groove width E is larger than ridge width F of the first threads and the second threads. The first threads 14 are loosely fit with the second threads 22 which allow the first threads 14 spirally go upward and downward and rotate along the second threads 22 to drive the first crushing portion 16 to engage with the second crushing portion 28 rhythmically. The embodiment also has the effect of the above embodiment, the quantity of generated powders of the rhythmic pill crusher of the embodiment can be controlled according to actual requirement, and the dosage of powders can be seen directly.

Figure 25:
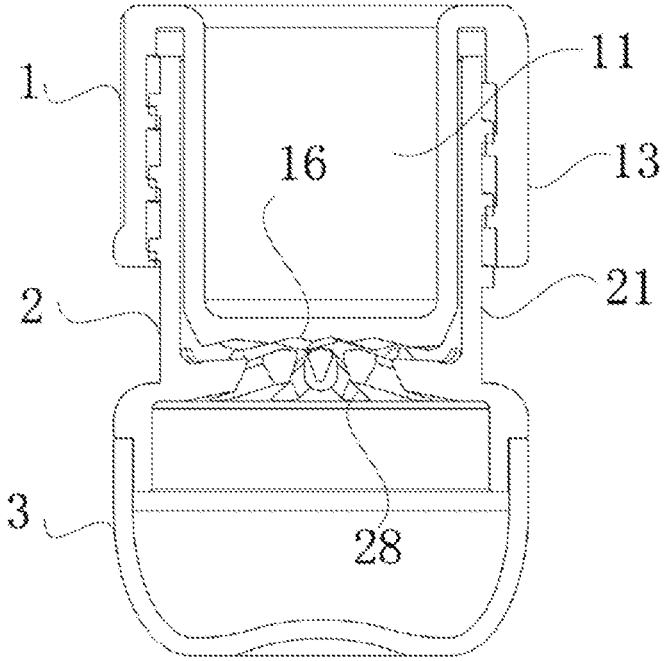
FIG. 25 shows a cross-sectional view of a rhythmic pill crusher of anther embodiment of the present disclosure.
Figure 26:
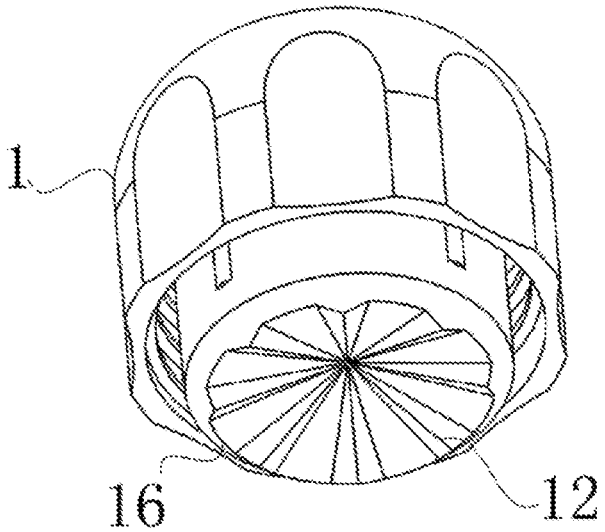
FIG. 26 shows a schematic view of a crushing cover of FIG. 25.
Figure 27:
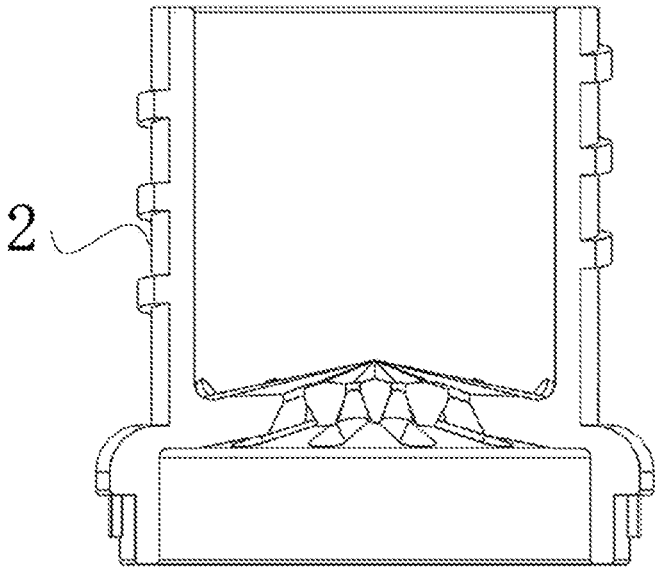
FIG. 27 shows a cross-sectional view of a support platform of FIG. 25.

FIGS. 25 to 27 show another embodiment of the rhythmic pill crusher, including a crushing cover 1, a support platform 2 and a cup 3. The differences from the above embodiments are: in the embodiment, the second crushing portion 28 includes a conical protrusion received by a conical recess of the first crushing portion 16. The number of the patterned holes 25 is gradually increased from the center to the edge of the second crushing portion 28, so the powders can fall through the patterned holes 25 around the second crushing portion 28 faster. In a preferable embodiment, the patterned holes 25 are evenly distributed on the edge of the conical protrusion of the second crushing portion 28. In another preferable embodiment, the patterned holes 25 are evenly distributed on the face of the conical protrusion and around the conical protrusion. Other technical features and effects are the same with the above embodiments, which will not be introduced here.

Figure 28:
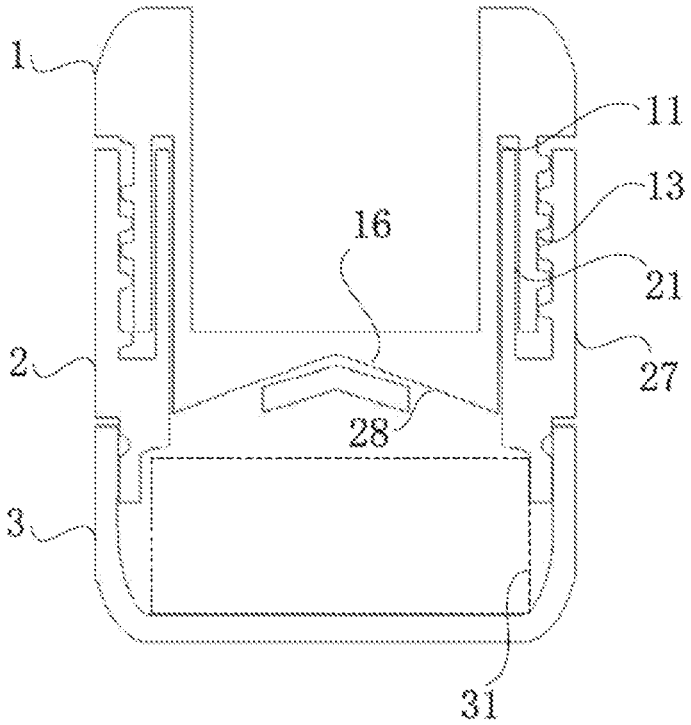
FIG. 28 shows a cross-sectional view of a rhythmic pill crusher of another embodiment of the present disclosure.

FIG. 28 shows another embodiment of the rhythmic pill crusher, including a crushing cover 1, a support platform 2 and a cup 3. The differences from the above embodiments are: in the embodiment, the support platform 2 includes a first annular wall 21 and a second annular wall 27 around the first annular wall 21. The first annular wall 21 is inserted between the cylindrical boss 11 of the crushing cover 1 and the annular side wall 13, the first threads 14 are formed on the external wall of the crushing cover 1, the second threads 22 are formed on the inner wall of the second annular wall 27, the external wall of the annular side wall 13 screws with the inner wall of the second annular wall 27. The four layers structure can well prevent the diffusion of the powders during rotation, to keep using environment clean. The cup 3, the first annular wall 21 and the support platform 23 form a storing structure 31, to store pills or other stuff. Other technical features and effects are the same with the above embodiments, which will not be introduced here.

On that account, the rhythmic pill crusher can be operated efficiently and easily, and can be cleaned easily for reducing cross contaminations. The rhythmic pill crusher and the method of use of the present disclosure have the following advantages:

(1) when the pill crusher is struck for the large hardness of the pills, the crushing cover can be rotated back and forth, to drive the first and the second crushing portions to grind the pills and rearrange the stacking powders, to prevent the pill crushers from stuck;

(2) for the first ridges rhythmically engaging with the second ridges, the grinding function is buffered, and a part of powders will be driven to fall through the patterned holes on the second crushing portion, therefore the powders in the cylindrical recess are decreased continuously to prevent the powders from excessive stacking;

(3) with the function of adjusting the air flow between the crushing cover and the support platform, the powders on the first and second crushing portions can be blown off, to get the pill crusher cleaned;

(4) the first threads are engaged with the second threads outside the cylindrical recess, to prevent the deciduous materials of the first and the second threads caused by abrasion from falling into the powders, it can be seen in FIG. 28 that the powders are well sealed in the cylindrical recess, a small quantity of powders falling from the cylindrical recess won't go back to the cylindrical recess.

What is claimed is:

1. A rhythmic pill crusher, including:

a crushing cover including a cylindrical boss, wherein a plurality of first threads formed on a first wall of the crushing cover and around a column portion of the cylindrical boss, and the cylindrical boss including a first crushing portion formed on a bottom face, wherein the first wall is distant from the column portion of the cylindrical boss; and a supporting platform including a cylindrical recess for receiving the cylindrical boss and a plurality of second threads formed, corresponding to the first threads, on a second wall of the supporting platform, and a second crushing portion formed, corresponding to the first crushing portion, on bottom of the cylindrical recess, the first crushing portion, the second crushing portion and an inner wall of the cylindrical recess forming a crushing chamber;

wherein the first threads and the second threads each include a plurality of ridges and a groove located between two adjacent ridges and the ridges of the first threads and the second threads is accommodated in the groove of the other first threads and the second threads; and wherein a groove width of the first threads and the second threads is larger than a ridge width of the first threads and the second threads such that the ridges of the first threads and second threads vertically move in the groove of the other of the first threads and the second threads.

2. The rhythmic pill crusher of claim 1, wherein a plurality of patterned holes for sifting powder out of the crushing chamber are formed on the second crushing portion.

3. The rhythmic pill crusher of claim 2, wherein the second crushing portion includes a conical protrusion received by a conical recess of the first crushing portion.

4. The rhythmic pill crusher of claim 3, wherein a plurality of patterned holes are evenly distributed on the edge of a conical protrusion of the second crushing portion.

5. The rhythmic pill crusher of claim 1, wherein the first crushing portion includes a conical protrusion received by a conical recess of the second crushing portion.

6. The rhythmic pill crusher of claim 1, wherein a plurality of first ridges are axis-symmetrically formed, around a central axis of the cylindrical boss, on the first crushing portion and a plurality of second ridges are axis-symmetrically formed, around a central axis of the cylindrical recess, on the second crushing portion.

7. The rhythmic pill crusher of claim 6, wherein the first ridges include a plurality of first protrusions formed, around the center axis of the cylindrical boss, and radially extended and the second ridges include a plurality of second protrusions formed, around the center axis of the cylindrical recess, and radially extended, wherein the size of the first protrusion is equal to the size of the second protrusion and a gap of the two adjacent first protrusions is equal to a gap of the two adjacent second protrusions.

8. The rhythmic pill crusher of claim 6, wherein the first ridge is extruded in a range of 0.1 mm to 10 mm in height from the first crushing portion and the second ridge is extruded in a range of 0.1 mm to 10 mm in height from the second crushing portion; the ridge width of the threads is in a range of 0.1 mm to 10 mm; and the groove width of the threads is in a range of 0.2 mm to 20 mm.

9. The rhythmic pill crusher of claim 1, wherein the first wall includes an inner wall of the crushing cover and the second wall of the supporting platform includes an external wall of the supporting platform, wherein the first threads formed on the first wall is loosely fit with the second threads formed on the second wall.

10. The rhythmic pill crusher of claim 1, wherein the supporting platform further includes an annular wall around the cylindrical recess and distant from the cylindrical recess, wherein the first wall includes an external wall of the crushing cover and the second wall includes an inner wall of the annular wall and wherein the first threads formed on the first wall is loosely fit with the second threads formed on the second wall of the annual wall.

11. The rhythmic pill crusher of claim 1, wherein the supporting platform includes a shoulder formed and around an external of the crushing platform and against the first wall.

* * * * *